United States Patent [19]

Dean

[11] Patent Number: 4,595,971

[45] Date of Patent: Jun. 17, 1986

[54] VENTED LUMINAIRE FIXTURE

[75] Inventor: John R. Dean, Memphis, Tenn.

[73] Assignee: FL Industries, Inc., Livingston, N.J.

[21] Appl. No.: 730,653

[22] Filed: May 6, 1985

[51] Int. Cl.[4] ..... F21V 7/20

[52] U.S. Cl. ..... 362/345; 362/364; 362/373; 362/294; 362/327; 362/332; 362/431

[58] Field of Search ..... 362/345, 343, 364, 294, 362/327, 332, 341, 431, 373

[56] References Cited

U.S. PATENT DOCUMENTS

| | | | |
|---|---|---|---|
| 1,329,280 | 1/1920 | Wohlauer | 362/343 |
| 1,821,955 | 9/1931 | Wuelker | 362/373 |
| 2,179,161 | 11/1939 | Rambusch et al. | 362/343 |
| 2,575,310 | 11/1951 | Yonkers et al. | 362/342 |
| 3,878,505 | 4/1975 | Seibert | 362/294 |
| 4,426,677 | 1/1984 | Dennis | 362/294 |

*Primary Examiner*—E. Rollins Cross

*Attorney, Agent, or Firm*—Laff, Whitesel, Conte & Saret

[57] ABSTRACT

The present invention provides a luminaire fixture having a generally cup shaped upper housing casting. A bowl shaped reflector is mounted thereto. The lower rim of the upper housing includes a flange extending outwardly and downwardly therefrom. The upper surface of the reflector includes a plurality of vent openings near its upper edge. The reflector is fitted to the lower edge of the housing such that the upper housing flange covers the vent openings in the reflector to prohibit rain and snow from entering the reflector. Further, the upper housing includes a rim extension contacting the upper surface of the reflector to seal the upper housing ballast compartment for safety requirements.

14 Claims, 4 Drawing Figures

VENTED LUMINAIRE FIXTURE

BACKGROUND OF THE INVENTION

The present invention relates to luminaire fixtures and, more particularly, to a luminaire fixture having a vented reflector assembly wherein the vents are overhung by a flange of the upper housing casting.

The dissipation of heat built up in a luminaire utilizing a mercury vapor or high pressure sodium lamp is a problem in the design and construction of such luminaire fixtures. The usual solution to provide necessary heat dissipation is to increase the size of the metal upper housing and the metal reflector assembly such that the necessary characteristics are obtained. However, this is an undesirable feature from a cost of material and a weight and size minimization point of view.

As such luminaires are typically utilized outdoors, another restriction on the design of the fixture is that in order to provide necessary safety in isolating the electrical components of the fixture from contamination and to meet Underwriters' Laboratories (UL) requirements, the compartment housing the ballast must be closed to the atmosphere. Typically in such fixtures the ballast is mounted in the upper housing casting. Accordingly, the reflector and refractor assemblies must be mounted to the upper housing casting in a manner such that the ballast compartment in the upper housing casting is essentially closed so as not to permit sparks or hot particles to escape in the event of a failure of the electrical components.

Accordingly, it is an object of the present invention to provide an outdoor luminaire fixture having improved heat dissipation properties without undue size while providing necessary isolation of the electrical components of the fixture.

SUMMARY OF THE INVENTION

The present invention provides a luminaire fixture having improved heat dissipation characteristics. The fixture is comprised of an upper housing casting usually of aluminum or an alloy thereof and having the shape of an inverted cup. The housing is of sufficient size to house the necessary electrical components of the fixture such as the ballast and the socket. Further, the housing usually has a mounting arm extending therefrom to permit the fixture to be readily mounted to a support structure such as a pole. The necessary electrical wires for the electrical connection of the fixture usually enter the fixture through a hollowed section of the mounting arm.

The lower edge of the cup shaped upper housing is formed into a flange. This flange has a first section extending radially outwardly from the lower edge of the housing and a second section extending downwardly from the first section. The flange conforms to the outer periphery of the lower edge of the housing and accordingly is usually circular in shape conforming to the cup shape of the upper housing. The lower edge of the upper housing also includes an extension arm which extends around the entire lower edge and is located inboard of the flange. The extension arm extends downwardly from the lower edge in general alignment with the side walls of the upper housing.

The extension rim contacts the flat upper surface of a bowl shaped reflector that is affixed to the upper housing. The reflector is generally bowl shaped having a generally flat upper surface and edges extending downwardly therefrom. The edges usually comprise a single curved section joined at an edge junction around the entire circumference of the upper surface and ending at a rim edge. The upper surface includes a plurality of openings near its edge junction. These openings can be of various configurations including circular, square or polygonal shape, but are usually of an elongated slot configuration. The slotted openings are near the edge junction of the upper surface of the reflector, and are positioned around the edge junction. The flange of the upper housing extends outwardly over the reflector openings and downwardly to or below the upper surface of the reflector. The vents or openings in the reflector permit the dissipation of heat from the lamp in the reflector compartment outward to the atmosphere. The flange prohibits rain, snow or splashing water from entering the vents.

The extension rim from the lower edge of the upper housing contacts the upper surface of the reflector around the entire circumference of the upper surface along a line inboard of the openings in the upper surface. This extension rim serves to seal the upper housing and its internally mounted electrical components for safety purposes.

Accordingly, the openings in the upper surface of the reflector are located neat the edge junction of the upper surface and the edge portion of the reflector so that the upper housing flange is located above and to the outside of the openings such that rain, snow or splashed water will not enter the reflector assembly. Further, the extension of the rim of the upper housing seals against the upper surface of the reflector to close the upper housing ballast compartment thereby meeting UL requirements.

A cup shaped refractor is joined to the internal surface of the edges or curved section of the reflector. This reflector usually includes a flange extending outwardly to cover the junction to insure that no contaminants such as rain or snow enter the refractor. The refractor is usually comprised of glass or clear plastic and usually fastened into contact with the reflector's lower edge by rolling the rim of the reflector over a lip on the refractor.

In particular, the present invention provides a lighting fixture comprising a head casting having a flange extending outwardly and downwardly from a lower edge thereof, a reflector assembly having a generally flat upper surface and a side surface joined thereto and extending downwardly therefrom, a plurality of openings in the upper surface of said reflector assembly, the reflector assembly being mounted against the lower edge of the head casting such that the head casting flange extends over the openings in the upper surface of the reflector assembly.

DESCRIPTION OF THE PREFERRED EMBODIMENT

Figure 1:
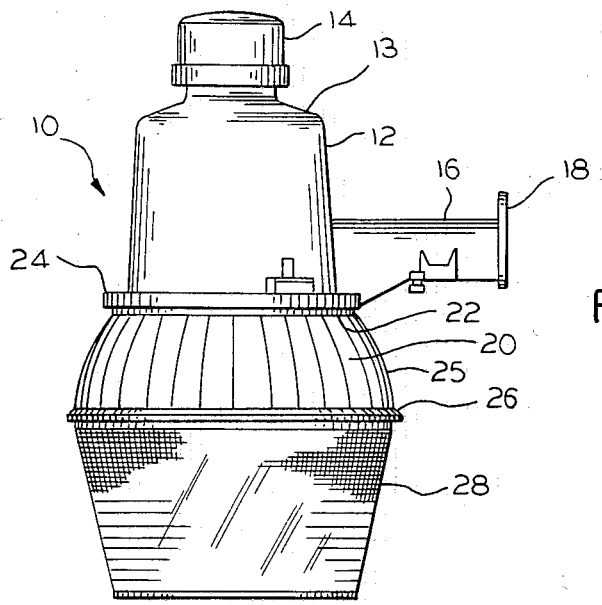
FIG. 1 is a side view of a luminaire fixture in accordance with the present invention.

Referring now to FIG. 1 of the drawings, a luminaire fixture in accordance with the present invention is shown generally at 10. Fixture 10 is comprised of cup shaped upper housing casting 12 having a support arm 16 extending from a side thereof. Support plate 18 is affixed to the end of arm 16 to assist in affixing fixture 10 to a support such as a pole. Cup shaped housing 12 includes tapering upper shoulders 13 that terminate in an upper receptacle adapted to receive photocontrol 14. The lower edge of the open cup end of upper housing 12 includes flange 24. As shown in greater detail in FIG. 2, flange 24 includes radial section 30 that extends radially outwardly from the wall of upper housing 12 and lower section 32 which extends downwardly from radial section 30 to or below the upper surface 22 of reflector 20.

Reflector 20 is a generally bowl shaped metallic device having a generally flat upper surface 22 with curved side surfaces 25 extending downwardly therefrom. Side surfaces 25 are, in effect, a single curved surface affixed to circular upper surface 22 to form edge junction 27. Reflector 20 also includes a rim flange 23 extending around its entire lower edge. Refractor 36 is a generally cup shaped glass or clear plastic device that is fastened at its upper outside edge into retention with the lower edge of reflector 20 by rolling the reflector rim over the rim on the upper edge of the refractor 36.

Upper housing 12 also includes a rim extension 34 extending downwardly into contact with the upper surface 22 of reflector 20. Rim extension 34 is circular in form and contacts upper surface 22 around the entire outer edge of upper surface 22 inboard from edge junction 27.

Figure 3:
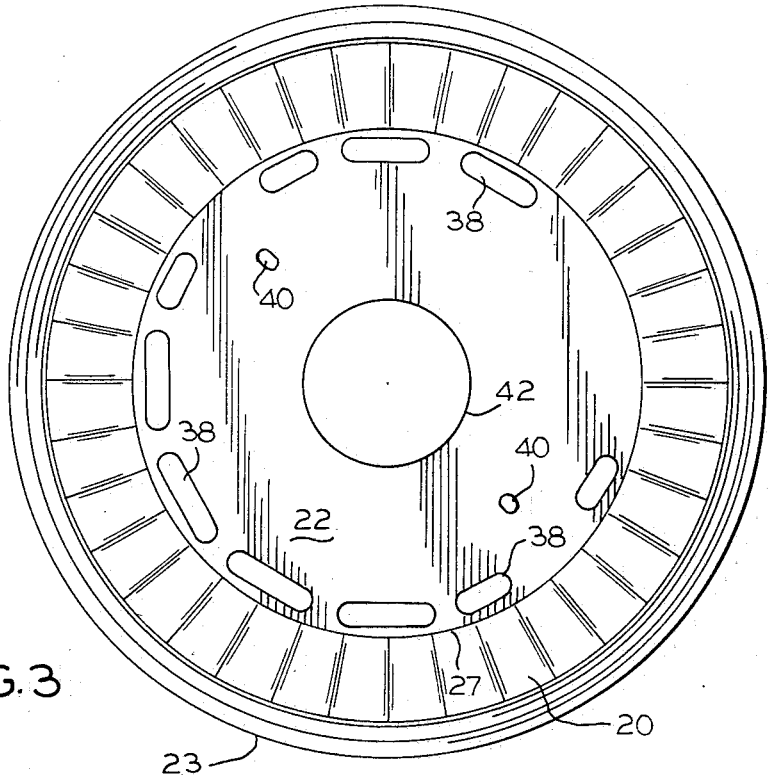
FIG. 3 is a top view of a reflector in accordance with the present invention.
Figure 4:
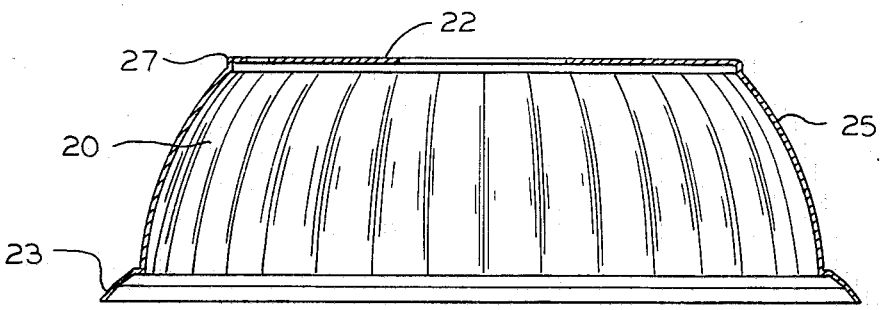
FIG. 4 is a side view of a reflector in accordance with the present invention.

Reflector 20 includes a plurality of elongated slots, vents or openings 38 in its upper surface 22 located around the outer edge of upper surface 22 near edge junction 27. Openings 38 are so positioned in upper surface 22 so as to be covered by flange 24 and rim extension 34 is inboard of openings 38. Detailed views of reflector 20 are shown in FIGS. 3 and 4.

Figure 2:
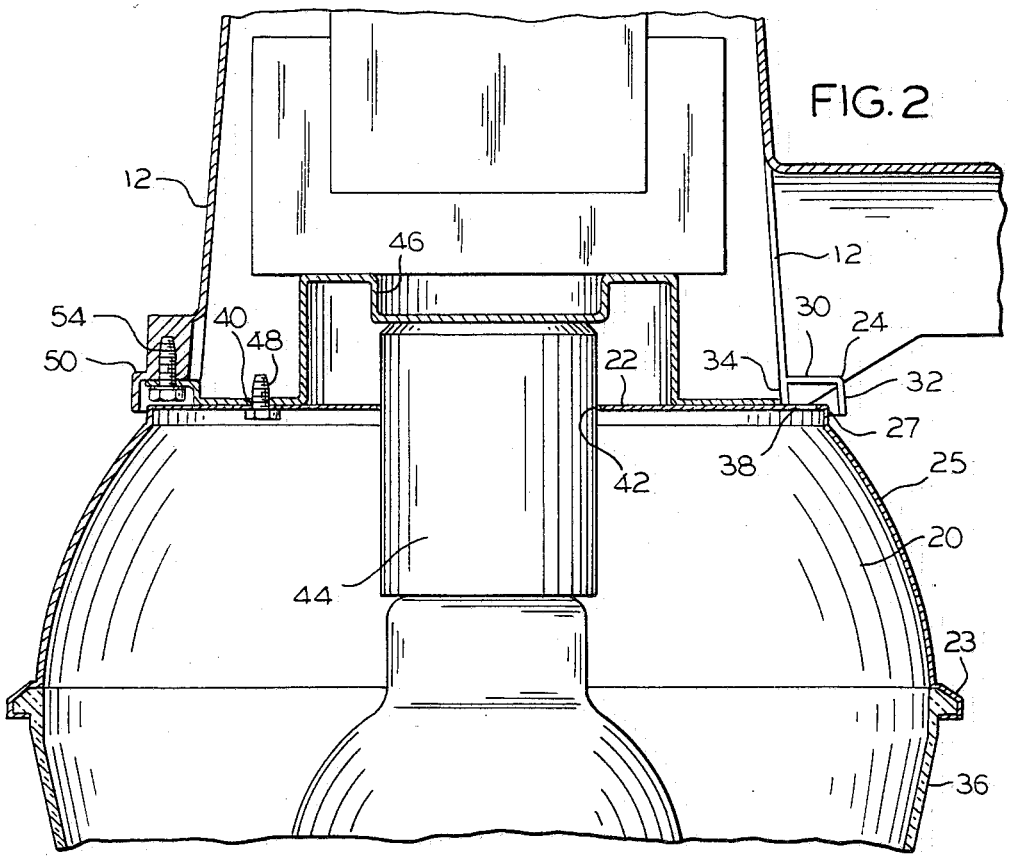
FIG. 2 is a detailed partial cross sectional view of a luminaire fixture in accordance with the present invention.

Upper surface 22 of reflector 20 includes a centrally located circular opening 42 through which lamp socket 44 passes. Lamp socket 44 is mounted to a socket 46 to which reflector 20 is also mounted by threaded screw 48 passing through opening 40 in reflector upper surface 22. The view of FIG. 2 is not a straight cross section of reflector 20 shown in FIG. 3 so that the alignment of opening 40 and vent 38 are not as shown in FIG. 3. Bracket 46 is held to a flange section 50 of upper housing 12 by threaded screw 54. Flange section 50 accomplishes the same function as flange 24 in covering the area of upper surface 22 of reflector 20 containing opening 38.

What is claimed is:

1. A lighting fixture comprising an upper housing, a reflector having an upper rim fitted to said upper housing and a refractor fitted to said reflector, wherein:

said upper housing includes a flange overhanging and spaced apart from the rim of the reflector fitted to head casting, and said reflector includes a plurality of openings on the rim fitted to said upper housing and located under said flange.

2. The lighting fixture of claim 1 wherein said upper housing is a metallic, generally cup shaped structure and the flange of said upper housing extends outwardly from the lower edge thereof.

3. The lighting fixture of claim 1 wherein said reflector is a metallic, generally bowl shaped structure having a generally flat upper surface and a curved side structure extending downwardly therefrom, and the rim of said reflector corresponds to the edge junction between the flat upper surface and the curved side structure with the plurality of openings located in the flat upper surface near the rim.

4. The lighting fixture of claim 3 wherein the openings in the flat upper surface are elongated slots.

5. The lighting fixture of claim 1 wherein the upper housing includes an extension seating against an upper surface of the reflector to close said upper housing against said reflector.

6. The lighting fixture of claim 1 wherein said upper housing flange overhangs the portion of the reflector rim including the openings therein.

7. A lighting fixture comprising an upper housing having a flange extending outwardly and downwardly from a lower edge thereof;

a reflector assembly having a generally flat upper surface and a side surface joined thereto and extending downwardly therefrom;

a plurality of openings in the upper surface of said reflector assembly;

the reflector assembly being mounted against the lower edge of the upper housing such that the upper housing flange extends over and is spaced apart from the openings in the upper surface of the reflector assembly;

said upper housing having a rim extension blocking all communication between said reflector and said upper housing via said openings.

8. The lighting fixture of claim 7 wherein said extension seats against the upper surface of said reflector assembly inboard of said openings.

9. The lighting fixture of claim 7 wherein said upper housing is generally cup shaped and said flange extends from lower edge thereof.

10. The lighting fixture of claim 9 wherein said reflector assembly is generally bowl shaped, and the plurality of openings are located at the outer periphery of said upper surface near the junction with said side surface.

11. The lighting fixture of claim 7 wherein said reflector assembly is generally bowl shaped and has a rim flange extending outwardly from its lower edge, and a refractor assembly adapted to be received internally within said reflector lower edge and said rim flange adapted to extend outwardly over the refractor top edge.

12. The lighting fixture of claim 7 wherein said plurality of openings in the upper surface of the reflector assembly act to vent the area enclosed by the reflector assembly to aid in the dissipation of heat therefrom.

13. The lighting fixture of claim 7 wherein said plurality of openings are spaced around the upper surface of said reflector assembly.

14. The lighting fixture of claim 7 wherein said openings are of an elongated configuration.

* * * * *